United States Patent [19]

McGuire et al.

[11] 4,371,045

[45] Feb. 1, 1983

[54] METHOD AND APPARATUS FOR RECOVERING UNSTABLE CORES

[75] Inventors: Patrick L. McGuire; Bruce L. Barraclough, both of Los Alamos, N. Mex.

[73] Assignee: The United States of America as represented by the United States Department of Energy, Washington, D.C.

[21] Appl. No.: 249,783

[22] Filed: Apr. 1, 1981

[51] Int. Cl.[3] ..... E21B 25/02; E21B 25/08; E21B 49/02

[52] U.S. Cl. ..... 175/17; 73/863.11; 175/58; 175/218; 175/246

[58] Field of Search ..... 175/17, 58, 59, 207, 175/218, 239, 240, 244, 246; 166/57, 302; 73/863.11, 864.44

[56] References Cited

U.S. PATENT DOCUMENTS

| | | | |
|---|---|---|---|
| 2,386,832 | 10/1945 | Zaikowsky et al. | 73/863.11 |
| 2,779,195 | 1/1957 | Simon | 175/17 |
| 2,812,160 | 11/1957 | West et al. | 175/17 |
| 2,915,285 | 12/1959 | Deily | 175/17 |
| 3,221,558 | 12/1965 | Lagergren | 175/17 |
| 3,318,394 | 5/1967 | Gleason, Jr. et al. | 175/17 X |
| 3,447,615 | 6/1969 | Schick | 175/17 |
| 4,317,490 | 3/1982 | Milberger et al. | 175/59 X |

FOREIGN PATENT DOCUMENTS

| | | | |
|---|---|---|---|
| 318696 | 10/1971 | U.S.S.R. | 175/17 |

OTHER PUBLICATIONS

Bily et al., "Naturally Occurring Gas Hydrates in the Mackenzie Delta, N.W.T.," *Bulletin of Canadian Petroleum Geology,* vol. 22, No. 3, (Sep. 1974), pp. 340–352.

Ward et al., *A Study to Determine the Feasibility of Obtaining True Samples of Oil and Gas Reservoirs,* BERC-/RI/-77/10, (Oct. 1977), pp. 7–16, and 43–61.

"DSDP Develops New Coring System," *Petroleum Engineer International,* Feb. 1981, p. 12.

NL Hycalog Diamond Bits and Coring Tools Brochure, Houston, Texas, pp. 17–18.

*Primary Examiner*—Stephen J. Novosad

*Attorney, Agent, or Firm*—Elizabeth O. Slade; Paul D. Gaetjens; Richard G. Besha

[57] ABSTRACT

A method and apparatus suitable for stabilizing hydrocarbon cores are given. Such stabilized cores have not previously been obtainable for laboratory study, and such study is believed to be required before the hydrate reserves can become a utilizable resource. The apparatus can be built using commercially available parts and is very simple and safe to operate.

12 Claims, 1 Drawing Figure

METHOD AND APPARATUS FOR RECOVERING UNSTABLE CORES

The invention is a result of a contract with the Department of Energy (Contract W-7405-ENG-36).

BACKGROUND OF THE INVENTION

This invention relates generally to a method and apparatus for removing unstable cores from the earth and relates more particularly to a method and apparatus for recovering substantially intact cores of hydrocarbon hydrates from the earth, including those located underneath a body of land or underneath a body of water.

Methane and other hydrocarbons are known to react with liquid water or ice to form solid hydrocarbon hydrates. These compounds are believed to exist in very large quantities in Arctic regions in gas-bearing sediments which lie between about one thousand and a few thousand feet below the earth surface. Therefore, these hydrates represent an enormous potential resource of hydrocarbons. Additionally, it is believed that these hydrates probably form to some extent in water-injected oil wells; and, therefore, the occurrence of these hydrate deposits within the earth is an important topic of study. However, relatively intact hydrate cores must be recovered in order to study various properties of the formation, including permeability distribution, excess gas or water content, and the acoustic and thermal properties of hydrate-bearing sediments.

Conventional coring systems are inadequate for recovering such unstable cores. In a conventional coring system, a pipe which is open at the bottom is drilled down into a deposit; and the core is simply brought to the surface through the pipe. No attempt is made to pressurize the pipe. And, unless one uses a device which can bring the core up very quickly (such as a wireline retrievable coring assembly) a period of several hours will be needed in order to remove the cores from the drill pipe. During this long period of time, hydrocarbon hydrate cores would be unstable. This is extremely significant because unstabilized hydrocarbon hydrate cores could cause an explosion, due to the rapid dissociation of the hydrates into the hydrocarbon gas and water. The danger of using conventional coring systems to remove hydrocarbon hydrates is described in C. Bily et al., "Naturally Occuring Gas Hydrates in the Mackenzie Delta, N.W.T.," *Bulletin of Canadian Petroleum Geology,* vol. 22, no. 3, (September, 1974), pp. 340–352. And, even if the hydrate cores are removed from the earth quickly by use of a wireline retrievable assembly in a conventional coring system, the unstabilized cores will rapidly disintegrate at the surface and (when located within metal tubing) they could act like bombs.

A pressure core barrel is a fully enclosed and highly pressurized device which is used to contain and bring up cores and adhering drilling fluid at the same pressures which were present in the earth formation. In pressure coring, an inner core barrel is closed at the top and bottom, thus sealing the core (located within the inner core barrel) under bottom hole pressure. The sealed, pressurized inner core barrel is generally brought up to the surface along with an outer barrel.

Coring of hydrates with a pressure core-barrel is considerably safer than using a conventional system, described above, provided that certain precautions are taken. These precautions are described in the Bily article cited above and include using cool drilling mud and special equipment at the surface for controlling the temperature of the hydrate-filled core barrel while it is being depressurized (as in the Scripps procedure, described below).

As reported by C. E. Ward and A. R. Sinclair in *A Study to Determine the Feasibility of Obtaining True Samples of Oil and Gas Reservoirs,* BERC/RI-77/10 (October 1977), on page 43, the most commonly used procedure for preserving pressure cores is by freezing with dry ice. Any drilling fluids located between the inner and outer core barrels must be removed prior to freezing. As disclosed in that report, this can be done by slowly forcing a gelled material through the barrel until all of the drilling fluids have been displaced. The core barrel is then placed into an insulated container and carefully frozen with dry ice, the freezing procedure requiring approximately one hour. Then, the pressure maintenance is disconnected and the outer core barrel is removed from around the inner core barrel. Standard pipe cutters are then used to section the inner barrel into easily handled lengths, the core is broken at each cut, and each section is wrapped with aluminum foil or plastic as quickly as possible (in order to prevent prolonged exposure of the core to materials such as nitrogen, hydrogen, and oxygen which can alter formation wettabilities), then replaced into insulated containers, and then covered with dry ice. After arrival at the laboratory, (as disclosed on p. 45 of that report), in order to prepare the frozen cores for analysis, the sleeve (i.e., barrel) containing the frozen core is removed by milling two grooves down opposite sides of the core, while maintaining the core in a frozen state, cooling the barrel with liquid nitrogen during the milling operation. Then, the sleeve is removed by prying it loose from the core. However, this method is not suitable for stabilizing hydrocarbon hydrates because much lower temperatures must be used to safely stabilize hydrate cores. Methane gas trapped inside the core barrel could still exist at high pressures (several hundred psi) at dry ice temperature. In addition, this method is very expensive and utilizes a lot of bulky, complicated equipment which would be very difficult to transport and use in the remote Arctic or offshore environments where hydrates have been encountered. In this method the drill string is pulled out after every core, and thus the system is not usable for operations like the Deep Sea Drilling Project (DSDP) being conducted by the Scripps Institute. Furthermore, any handling of unstabilized hydrates is very dangerous.

In order to retrieve hydrocarbon hydrates cores, Scripps Institute has designed special pressure coring equipment. This is desirable in cases where the drill string cannot be pulled out of the hole after coring, and the Scripps equipment is described in "DSDP Develops New Coring System," *Petroleum Engineer International,* February, 1981, p. 12. Only the inner core barrel is brought up to the surface; and it is wireline retrievable. However, the pressure core barrel equipment is very expensive (and, thus, is non-expendable), and is complicated (including a number of valves and seals). And to date, the only information about cores which has been obtained by using that pressure core barrel is blowdown information obtained by slowly bleeding off the hydrocarbon gas. No intact cores have been obtained by using this type of equipment. Instead, only various parameters were calculated from measurements on the gas that was given off when the hydrates dissociated. If the hydrate core was stabilized by freezing the core inside the pressure core barrel, the drilling fluid surrounding the core would also freeze. This drilling fluid, which is always present with the hydrate cores, would form an extremely tight fit in the pipe. These cores cannot simply be melted out of the pipe because the pipe and hydrate form a system which could generate high pressures and is thus very dangerous. Thus, the core barrel would have to be cut apart (and destroyed) to recover the core.

Therefore, despite what has been known in the prior art, there has been until now no method and apparatus for retrieving substantially intact cores of hydrates.

SUMMARY OF THE INVENTION

Objects of this invention are a method and apparatus for recovering unstable cores and particularly cores of hydrocarbon-containing hydrates in relatively intact form.

Further objects of this invention are a method and apparatus for simply, safely, and quite economically recovering such cores.

Further objects of this invention are a method and apparatus for stabilizing unstable cores, requirin Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the apparatus of this invention comprises: (a) a long outer pipe; (b) a conventional wireline retrievable core barrel (but having perforations) therein which passes within the long outer pipe; (c) various valves and ports which permit the upper portion of the long outer pipe to be used as a core chilling vessel; and (d) insulation which is packed around the chilling vessel. Through the perforations in the core barrel, cryogenic liquid passes into direct contact with the hydrocarbon hydrates and thus very efficiently stabilizes the core, both thermodynamically and mechanically. Furthermore, the perforations prevent pressure buildup; and this is of critical importance when hydrate cores are being recovered.

In a preferred embodiment, the apparatus is used in cooperation with cryogenic apparatus which passes a cryogenic fluid (for example, liquid nitrogen) through the chilling vessel.

In a further aspect of the present invention, in accordance with its objects and purposes, the method of the invention comprises:

(a) quickly removing from the earth an unstable core located in a core barrel at the bottom of the wellbore and quickly bringing the core (located within a core barrel) up into a core chilling vessel formed from the upper end of the outer pipe;

(b) then allowing drilling fluid to drain from the core and the chilling vessel; and (c) then circulating a cryogenic fluid through the chilling vessel to stabilize the core.

In a preferred embodiment, the core and core barrel are removed by means of a wireline retrieval assembly and the core barrel is perforated, thus permitting very good drainage of the drilling fluid from the hydrate core, permitting very little pressure build-up in the core barrel, and permitting very efficient stabilization of the core by the cryogenic fluid when it comes into direct contact with the core through the perforations.

By the practice of the invention, it is expected that cores of hydrocarbon hydrates can be obtained and then later studied in a laboratory setting. By use of the method and apparatus of the invention, hydrocarbon hydrate cores (including those of methane) can be recovered very safely, inexpensively, and simply. Additionally, although some degree of dissociation of the core into gas and liquid may occur and thus some fluid loss any occur, it is expected that the inner part of the core will remain virtually intact. Thus, data concerning the total gas content of a hydrate reservoir should be comparable in quality to pressure core data and should be much better than conventional core data. Additionally, using the method and apparatus of this invention, data is obtainable which is not even possible by use of pressure coring or conventional coring because it has not been possible by using those methods to retrieve and preserve for laboratory study a hydrate core of unstable nature.

Furthermore, the apparatus and method of this invention can also be used to study gas production from shales or from methane drainage from coal seams and could be used in more conventional coring operations, for example in enhanced oil recovery evaluation or tight gas sand evaluation.

Although it has been known to preserve pressure cores by placing the core barrel (housing the core) into an insulated container and then carefully freezing with dry ice as described above, it is believed that the upper portion of the outer pipe has not itself previously been used as the chilling vessel through which a cryogenic fluid is pumped. Additionally, in the prior art, the core barrel would be frozen to the core, whereas here the core barrel has perforations therein and the drilling fluid will be drained from the core prior to freezing. It is believed that a perforated core barrel has not previously been used.

BRIEF DESCRIPTION OF THE DRAWING

The accompanying drawing, which is incorporated in and forms a part of the specification, illustrates an embodiment of the present invention and, together with the description, serves to explain the principles of the invention. In the drawing is shown a partially schematic illustration in cross section of an embodiment of the apparatus of the invention suitable for retrieving and stabilizing hydrocarbon hydrate cores and other unstable cores.

DESCRIPTION OF THE PREFERRED EMBODIMENTS

Figure 1:
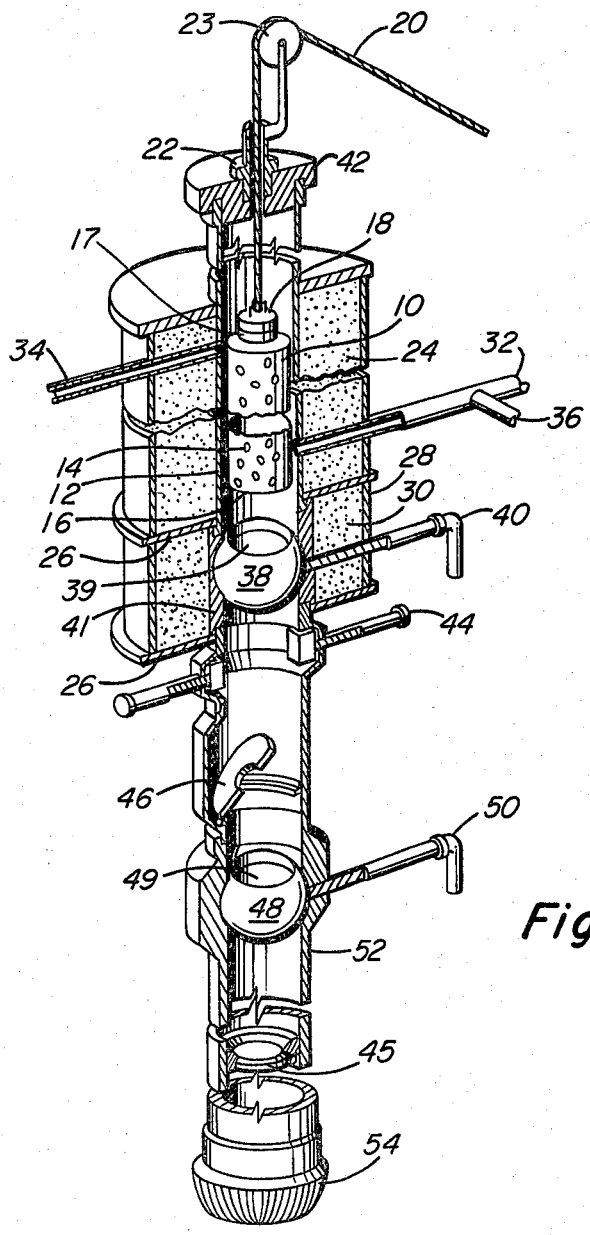

In the practice of the method of the invention, it is required that the unstable core be quickly brought up into the cooling vessel which is formed from the upper portion of the outer pipe.

Although any degree of cooling helps to stabilize hydrocarbon hydrate cores, in order to obtain a methane hydrate core which is safe enough for shipment to a laboratory, the core should be cooled down at least to −80° C. (at which temperature the pressure of methane hydrates is 1 atmosphere). If the cooling temperature is not lowered to this extent, methane hydrates would not be stable at atmospheric conditions and thus would readily decay. A cooling temperature for other hydrocarbon hydrates would be chosen similarly.

By using the upper portion of the outer pipe as a chilling vessel and cooling with a cryogenic fluid, one can very conveniently stabilize hydrocarbon hydrate cores. When the cores are quickly brought up into the chilling vessel and quickly stabilized at cryogenic temperatures, the cores remain virtually intact and no expensive pressure core barrel need be used, although the outer pipe will preferably be quite strong (i.e., able to withstand pressures up to at least about 5000 psi) as a safety precaution.

Referring to the drawing, (which is substantially to scale, with the exception of the sheave assembly and parts 17), a wireline-retrievable core barrel 10 is shown located within the upper portion of outer pipe 12. The wireline-retrievable core barrel 10 has a multiplicity of perforations or holes 14, through which drilling fluid can drain, evolved hydrocarbon gas can pass, and cryogenic fluid can pass so that it contacts the hydrate core. The core barrel 10 is open at its lower end 16. At its upper end, core barrel 10 has attached thereto parts 17 (which include the upper bearing assembly, latch mechanism and fishing neck, not shown in detail and not to scale) and an attachment device 18 (e.g., an overshot) for attaching wireline 20 to core barrel 10. Wireline 20 passes through wireline seal assembly 22, (which can be, for example, a grease-injected wireline seal assembly or more preferably a stuffing box, which allows wireline 20 to move up and down but does not allow gas or liquid to escape to the environment). Wireline 20 passes around a sheave assembly 23 (which will generally have 2 or more grooved wheels or pulleys).

The upper portion of outer pipe 12 is surrounded with insulation 24, which rests upon insulation support plates 26 and which is covered by an outer shell 28, thus forming chilling vessel 30.

Through chilling vessel 30, cryogenic liquid is passed via a cryogenic liquid inlet 32 located below a cryogenic liquid outlet 34, which leads to a disposal (not shown). Cryogenic liquid inlet 32 can have a bleed line 36 located therein, through which drilling fluid can drain prior to introduction of cryogenic liquid for stabilizing the hydrate core. However, if desired, bleed line 36 can be separate from cryogenic fluid inlet 32; however, both should be located quite near the bottom of chilling vessel 30.

Located within outer pipe 12 near the bottom of chilling vessel 30 is a full-opening valve 38 (which can be a gate valve, a plug valve, or a ball valve). Core barrel 10 passes through a hole 40 in valve 38 when valve 38 is open. When closed, valve 38 serves to isolate chilling vessel 30 from lower portions of the assembly. Valve 38 should be a high pressure valve and should be able to withstand cryogenic temperatures. Thus, a gate valve (which has a metal-to-metal seal) can be used, although then the outer pipe must be large enough to accomodate the sliding portion of the gate valve and the time to actuate the gate valve will be generally longer than the time to actuate a ball valve. A ball valve or plug valve (in the shape of a cylinder) which satisfies the above-recited temperature and pressure requirements can alternatively be used. Handle 40 can be used to open and close valve 38 manually. Also shown in the drawing is a housing 41 (made of metal) for valve 38 when valve 38 is a ball valve.

Above the top of chilling vessel 30, inner pipe 12 extends a short distance and is closed at its upper end by threaded cap 42, which has a channel located therein, through which wireline 20 can pass.

Immediately below the bottom of chilling vessel 30, an optional wireline valve 44 can be placed. Wireline valve 44 can be, for example, a single ram wireline manually actuated valve.

Alternatively and preferably, instead of wireline valve 44, a one-way valve 45 located downhole (and sometimes called a float shoe) can be used and will be much less expensive than commercially available wireline valves. The float show will be placed approximately two inches above the top of the drill bit assembly located downhole and will act to prevent fluids from rising within outer pipe 12.

Located below optional wireline valve 44 in the drawing is tool trap 46, which will preferably be used. Tool trap 46 acts as a flapper valve, stopping movement of the core and core barrel 10 in the event that wireline 20 were to break.

Located immediately below tool trap 46 is a second full-opening valve 48 (as described above) having a handle 50 which can be operated manually to seal off the portions of outer pipe 12 located above valve 48. Valve 48 will need to be used if tool trap 46 is used in order to prevent a safety hazard which might occur if the core dropped down to tool trap 46 and lodged there.

The portion of outer pipe 12 located above valve 48 should be a high pressure vessel capable of withstanding up to at least about 5000 psi in order to prevent any safety hazards which might occur if there were a failure in introducing cryogenic fluid into chilling vessel 30. This portion of outer pipe 12 from valve 48 up to threaded cap 42 will often be about 30 feet long.

Located below valve 48 is a converter 52 (for example, an adapter sub) which is used to convert the upper portion of outer pipe 12 (which is a standard pipe) to the lower portion of outer pipe 12 (which is a standard drilling pipe). At the bottom of outer pipe 12, the drill coring bit 54 is shown.

The operation of the apparatus of the invention is as follows. The wireline-retrievable core barrel 10 is lowered to a depth at which it contacts the formation being investigated. Very cold drilling fluids (e.g. −40° to −50° C.) should then be circulated into the hole. The drill coring bit 54 then drills into the formation; and a core of hydrate is forced into the core barrel 10. The bottom of outer pipe 12 remains embedded in the formation, while core barrel 10 is brought up through the very cold drilling fluids, into chilling vessel 30 by means of wireline 20 which is pulled around sheave assembly 23. Fluid can drain out of the bottom of core barrel 10 and through the perforations 14 therein during the time of ascent of the core. When core barrel 10 is located within chilling vessel 30, drilling fluid can continue to drain out through bleed line 36 until the start of introduction of cryogenic fluid. The time required to bring the hydrate core up into chilling vessel 30 and to begin introducing cryogenic liquid is on the order of about 10 minutes, a relatively short period of time. Then, valves 38 and 48 and bleed line 36 are closed and cryogenic fluid is introduced into the upper portion of outer pipe 12 via inlet conduit 32, thus chilling core barrel 10 and the hydrate core located therein. When the hydrate core begins to be chilled, the cryogenic liquid boils and passes out of cryogenic liquid outlet conduit 34. Cyrogenic liquid is fed into chilling vessel 30 until this boiling stops and for a short time period (for example, about 5 minutes) thereafter. Then, threaded cap 42 is removed and wireline-retrievable core barrel 10 is pulled upward. The top of core barrel 10 is then unscrewed from the sides of core barrel 10 and the hydrate core can be pushed out of core barrel 10 and then sectioned and placed into a Dewar vessel. Thus, the core barrel itself need not be sectioned.

Liquid nitrogen is the preferred cryogenic liquid because it is relatively inexpensive, is inert to the cores, is widely available, and can chill the cores to extremely low temperatures (i.e., about −320° F.).

ILLUSTRATIVE EMBODIMENT

Apparatus according to the invention can be built in the following way, using the items described below (which are all compatible with one another) and assembling them as shown in the drawing.

A suitable wireline-retrievable core barrel 10 is model 77, which can be purchased from NL Hycalog Company.

A suitable sheave assembly 22 can be purchased from Otis Engineering Corporation and is model 93H19.

The upper portion of outer pipe 12 can be a high pressure lubricator pipe, model no. 46RF226, which is obtainable from Otis Engineering Corporation.

The insulation 24 should be about 5 inches thick and can be polyurethane foam, which is obtainable from a number of vendors. The outer shell 28 of chilling vessel 30 can be made of any strong, waterproof material.

If used, optional wireline valve 44 can be a single raw wireline manually-actuated valve, model no. 46B0152 and obtainable from Otis Engineering Corporation.

If a one-way valve (or float shoe) is used instead of wireline valve 44, it can be a Baker Float Valve Assembly, obtainable from Baker Packers, Inc.

A suitable tool trap 46 is a Bower Manual Tool Trap, model no. 46024, obtainable from Bower Tools, Inc.

A suitable wireline seal assembly 22 is a flourosilicane packing element subassembly, model no. 46G036, obtainable from Otis Engineering Corporation.

A suitable full-opening valve for valves 38 and 48 is a 4 inch full opening gate valve, obtainable from Barton Valve Company (Shawnee, Oklahoma).

The foregoing description of preferred embodiments of the invention has been presented for purpose of illustration and description. It is not intended to be exhaustive or to limit the invention to the precise forms disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of obtaining for laboratory study substantially intact cores of hydrocarbon hydrates, said method comprising:

(a) drilling a core out of a formation in the earth;

(b) very quickly bringing said core located within a core barrel open at its lower end up above the earth surface;

(c) allowing drilling fluid to drain out of said core barrel and away from said core; and then (d) passing cryogenic fluid in contact with said core located within said core barrel while said core and said core barrel are located within a chilling vessel which is formed from the upper portion of the outer pipe which houses said core and said core barrel, thus forming a stabilized core.

2. A method according to claim 1, and including also the step of sliding said stabilized core out of said core barrel and storing at least a portion of said stabilized core within a Dewar flask.

3. A method according to claim 1 or claim 2, wherein said core barrel is a wireline-retrievable core barrel and is brought up from said formation by means of a wireline retrieval assembly.

4. A method according to claim 3, wherein said core barrel has perforations therein.

5. A method according to claim 4, wherein said cryogenic liquid is liquid nitrogen, and wherein very cold drilling fluids are used during coring and retrieval of cores.

6. An apparatus comprising:

(a) an outer pipe having a first end and a second end and having a top portion and a bottom portion, wherein said second end is to be fastened into the earth;

(b) a core barrel which is open at its bottom, which has perforations therein, which is located within said outer pipe, which moves between said first end and said second end of said outer pipe, and which is suitable for housing a core which is being brought up from the earth to said top portions;

(c) a means for very quickly transporting said core barrel and a core located therein up from the earth to said top portion;

(d) an isolation means for isolating said top portion from said bottom portion when said core and said core barrel are located within said top portion;

(e) an insulating means for insulating the exterior of said top portion; and (f) an inlet means and an outlet means for passing cryogenic fluid into and out of said top portion and wherein said inlet means is located below said outlet means and near the bottom of said top portion.

7. An apparatus according to claim 6, wherein said apparatus includes also an outlet means for allowing fluid to drain away from said core barrel and said core prior to the introduction of cryogenic fluid into said top portion.

8. An apparatus according to claim 7, wherein said means for quickly transporting said core barrel and said core is a wireline seal assembly operated in cooperation with a sheave assembly and wherein said apparatus is operated in cooperation with cryogenic liquid equipment.

9. An apparatus according to claim 8, wherein said top portion is an insulated high pressure pipe.

10. An apparatus according to claim 9, wherein said isolation means is a full opening valve.

11. An apparatus according to claim 10, wherein a second full opening valve is located below said top portion and acts as a safety valve.

12. An apparatus according to claim 11, and including also a downhole one-way valve which prevents fluids from coming up into said top portion.

* * * * *